US007300357B2

(12) United States Patent
Breaker et al.

(10) Patent No.: US 7,300,357 B2
(45) Date of Patent: Nov. 27, 2007

(54) PRACTICE SPORT PROJECTILE HAVING A THROUGH HOLE

(76) Inventors: Richard C. Breaker, 135 S. Joyce St., Golden, CO (US) 80401; John V. Breaker, 15124 W. Bayaud Ave., Golden, CO (US) 80401

( * ) Notice: Subject to any disclaimer, the term of this patent is extended or adjusted under 35 U.S.C. 154(b) by 432 days.

(21) Appl. No.: 10/359,331

(22) Filed: Feb. 5, 2003

(65) Prior Publication Data

US 2003/0162603 A1 Aug. 28, 2003

Related U.S. Application Data

(60) Provisional application No. 60/359,415, filed on Feb. 23, 2002.

(51) Int. Cl.
*A63B 41/00* (2006.01)

(52) U.S. Cl. ..... 473/280; 473/594; 473/613; 273/DIG. 20

(58) Field of Classification Search ..... 473/280, 473/281, 588, 595, 200, 374, 575, 576
See application file for complete search history.

(56) References Cited

U.S. PATENT DOCUMENTS

| | | | | |
|---|---|---|---|---|
| 697,417 | A | 4/1902 | Kempshall | |
| 715,795 | A | 12/1902 | Haskell | |
| 1,293,941 | A | 2/1919 | Sargent | |
| 1,483,165 | A | 2/1924 | Eaton | |
| 2,020,484 | A | 11/1935 | Turner | |
| 2,211,330 | A | 8/1940 | Hochberg | |
| 2,597,704 | A | 5/1952 | Carlson | |
| 2,705,148 | A * | 3/1955 | Waller | 273/317 |
| 2,953,922 | A | 9/1960 | Bonkowski et al. | |
| 3,117,788 | A | 1/1964 | Buonanno et al. | |
| 3,264,776 | A * | 8/1966 | Morrow | 446/34 |
| 4,003,574 | A * | 1/1977 | MacDonald et al. | 473/613 |
| 4,006,908 | A | 2/1977 | Minami | |
| 4,691,922 | A | 9/1987 | Peel et al. | |
| 4,794,905 | A * | 1/1989 | Woolard | 124/5 |
| 4,836,552 | A | 6/1989 | Puckett et al. | |
| 5,033,743 | A | 7/1991 | Wright | |
| 5,066,012 | A | 11/1991 | Stark | |
| 5,123,645 | A * | 6/1992 | MacDonald et al. | 473/594 |
| 5,129,650 | A * | 7/1992 | Hayman | 473/289 |
| 5,269,520 | A | 12/1993 | Vellines | |

(Continued)

FOREIGN PATENT DOCUMENTS

JP 2001087421 A * 4/2001

*Primary Examiner*—Nini F. Legesse
(74) *Attorney, Agent, or Firm*—Holland & Hart LLP

(57) ABSTRACT

Non-standard sport projectiles, in accordance with this invention, include at least one linear through hole. As this non-standard sport projectile passes through the air, after being hit by, for example, a golf club, the non-standard sport projectile spins. When the above-mentioned through hole is generally aligned with the projectile's direction of flight, air passes through the through hole, and the aerodynamic characteristics of the non-standard sport projectile are enhanced. When the through hole is not aligned with the projectiles direction of flight the aerodynamic characteristics are reduced. As a result, the non-standard sport projectile experiences rapidly repeating intervals of relatively high aerodynamic flight and relatively low aerodynamic flight as the non-standard sport projectile spins around the center cross section of the through hole.

25 Claims, 7 Drawing Sheets

U.S. PATENT DOCUMENTS 5,470,076 A 11/1995 Cadorniga
5,480,154 A 1/1996 Barnhill et al.
D371,178 S * 6/1996 Pearson ..... D21/712
5,597,161 A 1/1997 Bellchumeur et al.
5,611,737 A 3/1997 Rau et al.
D386,229 S * 11/1997 Hicks ..... D21/712
5,707,308 A 1/1998 Liu
5,782,702 A 7/1998 Yamagishi et al.
5,782,703 A 7/1998 Yamagishi et al.
5,944,621 A 8/1999 Tsujinaka et al.
6,045,469 A * 4/2000 Gleason et al. ..... 473/613
6,200,238 B1 3/2001 Tackett
6,440,346 B1 * 8/2002 Wai et al. ..... 264/254
6,595,874 B2 * 7/2003 Sullivan et al. ..... 473/374

* cited by examiner 15
17
19
24
16
20
25
21
12
13
22
23
18
14
15
24
13
16
19
20
25
21
22
12
14
17
23
18
15
24
13
16
19
20
25
21
12
14
22
17
18
23
15
24
13
16
19
20
25
21
12
14
18
17
22
23
15
24
13
16
19
20
25
21
12
14
18
17
22
23
15
19
13
16
20
18
12
14
17
15
13
16
12
14
15

PRACTICE SPORT PROJECTILE HAVING A THROUGH HOLE

This application claims the benefit of U.S. provisional patent application Ser. No. 60/359,415 filed Feb. 23, 2002 entitled AERODYNAMIC PROJECTILE WITH THROUGH HOLE, incorporated herein by reference.

FIELD OF THE INVENTION

This invention relates to the field of sport projectiles, and more particularly, to a non-standard or practice sport projectile that includes a though-hole whose linear axis is generally centered within the non-standard sport projectile, such that when properly struck the projectile rotates around the center cross section of the through hole allowing airflow through the opening during part of its rotation and blocking airflow during part of its rotation (i.e., in a tumbling action instead of a spiral action).

BACKGROUND OF THE INVENTION

In many sports it is desirable to repeatedly practice a physical motion wherein an object strikes a sport projectile such as a golf ball type, baseball type, and/or a football type projectile.

In the sport of golf, practicing the physical motion of swinging a golf club and striking a golf ball allows one to become a successful golfer. In particular, the ability to consistently repeat a golf swing, so as to obtain a consistent flight of a golf ball, is important to becoming a successful golfer.

In the sport of golf there are many ways to practice the art of striking a golf ball. A method most similar to actually playing golf on a golf course is to hit or drive standard or regulation golf balls at a driving range. However, practice-driving ranges are often inconveniently located, and they are expensive. Alternative to the use of a driving range, one can use standard golf balls to practice in the backyard of a home, in a vacant lot, or in an open field. However, practicing a full golf swing in this type of a geographic area leaves much to be desired. Often a back yard is not large enough to enable a golfer to use long distance golf clubs, and vacant lots or fields are often not readily available. Further, unless a golf swing is somewhat consistent, retrieving standard golf balls can be a tedious and time-consuming activity. Another alternative is to hit standard golf balls into a net. However, this option prevents observation of the ball's flight through the air. While a golfer can practice his or her swing using this option, it is difficult to judge whether a swing actually produces a desired flight of a standard golf ball. Another alternative is to hit a non-standard, lightweight golf ball, such as a foam or hollow plastic golf balls. However these non-standard golf balls are so light that the "club's feel", as the golf club impacts this type of non-standard golf ball, is insignificant when compared with striking a standard golf ball. In addition, the flight of such a light weight, non-standard golf ball is not a realistic experience. Furthermore, wind currents that may have little influence on a standard golf ball can greatly influence the flight of these non-standard, lightweight practice golf balls. Yet another option is to practice hitting a standard golf ball into a net using expensive tracking devices. These devices can monitor the ball's speed, trajectory and spin, and then report a theoretical flight path for the standard golf ball. None of the above options are satisfactory, leaving most serious practice to the driving range.

Thus, it is desirable to provide a practice or non-standard sport projectile to be used when practicing a golf swing, when practicing a football kick, and/or when practicing a baseball swing. The non-standard sport projectile should mimic the "impact feel" of a standard sport projectile. It should also mimic the flight path of a standard sport projectile. Finally, the non-standard sport projectile should be capable of use within a relatively small geographic area.

SUMMARY OF THE INVENTION

Various features, utilities and advantages of non-standard sport projectiles, in accordance with the invention, will be apparent from the following description of preferred embodiments, as illustrated in the accompanying drawing.

When actually playing golf on a golf course, a golfer use a standard golf ball or sphere, because the roll of the standard golf ball after the ball lands, and the roll of the standard golf ball when putting, which are as much a part of the game of golf as is the driving of the standard golf ball and the subsequent flight of the ball. However, practicing a golf club swing, to thereby strike a golf ball, and then observing the subsequent flight of the ball, can be accomplished when using a non-standard golf ball having an external spherical shape or non-spherical shape as is provided by the present invention. This invention provides a new, unusual and unobvious non-standard practice sport projectile that simulates the "feel" and the flight of a standard sports projectile, of which a standard golf ball is a non-limiting example. This invention provides a non-standard sport projectile that is constructed and arranged to "feedback" a "striking feel" to an individual that is generally consistent with the striking of a standard sport projectile, such as a golf club for golfing, a foot for football, or a bat for baseball.

Non-standard sport projectiles, in accordance with this invention, include at least one linear through hole. As this non-standard sport projectile passes through the air, after being hit by, for example, a golf club, the non-standard sport projectile spins. When the above-mentioned through hole is generally aligned with the projectile's direction of flight, air passes through the through hole, and the aerodynamic characteristics of the non-standard sport projectile are lessened. As a result, the non-standard sport projectile experiences rapidly repeating intervals of relatively high aerodynamic flight and relatively low aerodynamic flight as the non-standard sport projectile spins. Thus, non-standard sport projectiles, in accordance with the invention, provide a satisfactory "feel" on impact, they mimic the flight of a standard sport projectile, but the length of flight of the non-standard sport projectile is considerably shorter than the length of flight of a standard sport projectile.

BRIEF DESCRIPTION OF THE DRAWING

The present invention will be apparent upon considering the following detailed description of embodiments of the invention, taken in conjunction with the accompanying drawings:

FIG. 2A provides a side view of six different size non-standard golf balls having a circular-cylinder external surface and a relatively small-size center-located through hole.

FIG. 2B provides a side view of five different size non-standard golf balls having a radiused external surface and a relatively small center-located through hole.

FIG. 2C provides a side view of four different size-non-standard golf balls having a spherical external surface and a relatively small size center-located through hole.

FIG. 3A shows the non-standard golf ball sitting on the ground with the axis of its through hole facing upward as the head of a golf club is about to strike the non-standard golf ball.

FIG. 3B shows the compression of the non-standard golf ball as the club's head strikes the non-standard golf ball.

FIG. 3C shows the non-standard golf ball as it begins its flight and as the non-standard golf ball begins to spin in a counterclockwise direction due to the force applied thereto by the club's head.

FIG. 3D shows the continued flight and spinning of a non-standard golf ball.

FIG. 3E shows the least-aerodynamic position of the spinning non-standard golf ball during its flight through the air.

FIG. 3F shows the most-aerodynamic position of the spinning non-standard golf ball during its flight through the air.

Figures 2A, 2B, 2C:
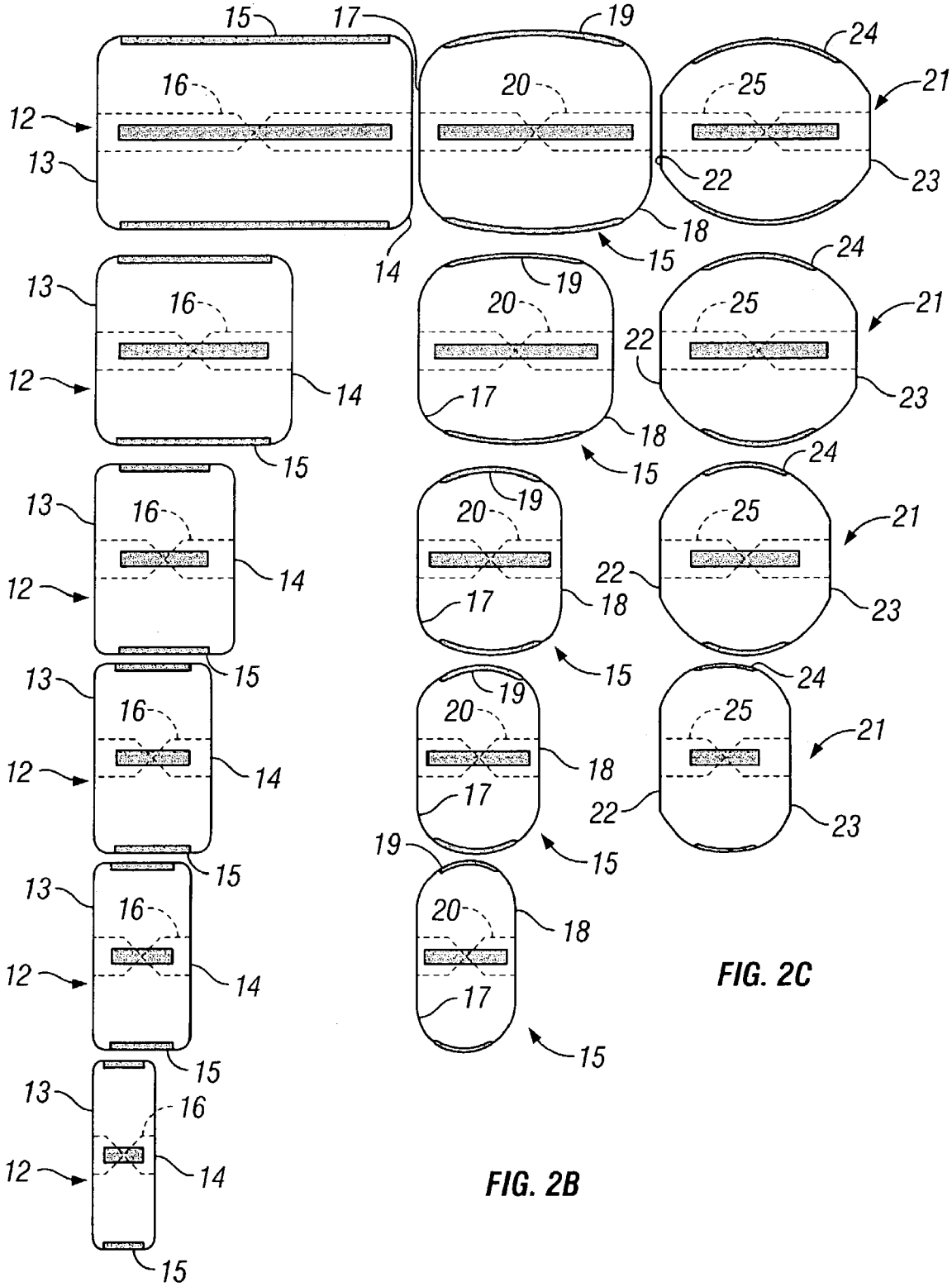
FIGS. 2A, 2B and 2C provide a number of side views of different types of non-standard golf ball, in accordance with the present invention, wherein the axis of the through holes that are provided within the non-standard golf ball extend in a horizontal direction in the figures.

FIB. 9B is a cross section view of a non-standard golf ball of the type shown in FIG. 2B wherein the non-standard golf ball includes a circular-cylinder insert that is made of spring steel or of a high modulus polymer, the axis of this internal cylindrical insert being coincident with the axis of the non-standard golf ball's through hole.

Figure 9A:
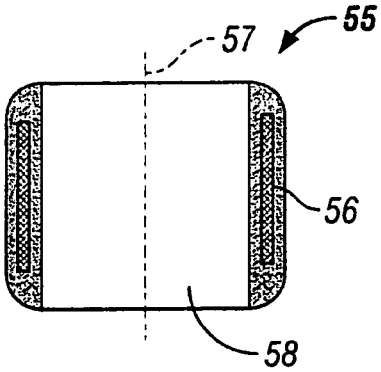
FIG. 9A is a cross section view of a non-standard golf ball of the type shown in FIG. 2A wherein the non-standard golf ball includes a cylinder insert that is made of spring steel or of a high modulus polymer, the axis of this internal cylindrical insert being coincident with the axis of the non-standard golf ball's through hole.
Figure 9B:
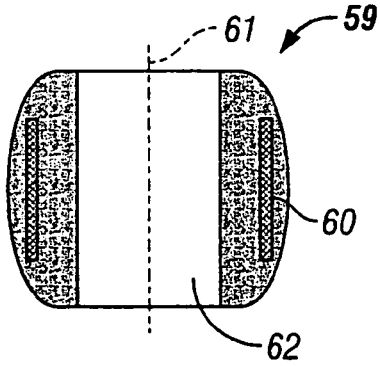
Figure 9C:
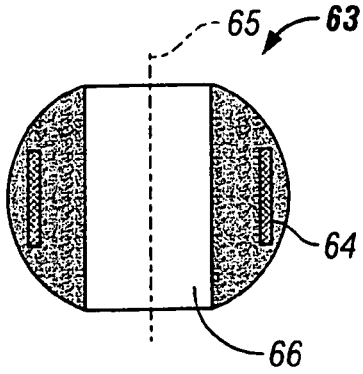

FIG. 9C is a cross section view of a non-standard golf ball of the type shown in FIG. 2C wherein the non-standard golf ball includes a circular-cylinder insert that is made of spring steel or of a high modulus polymer, the axis of this internal cylindrical insert being coincident with the axis of the non-standard golf ball's through hole.

Figure 10C:
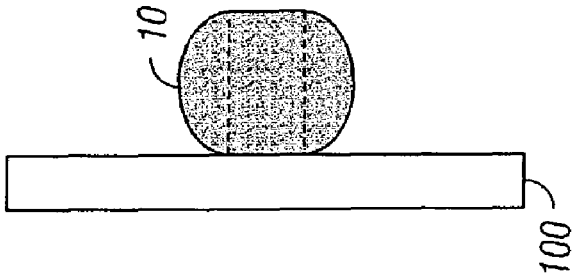
Figure 10A:
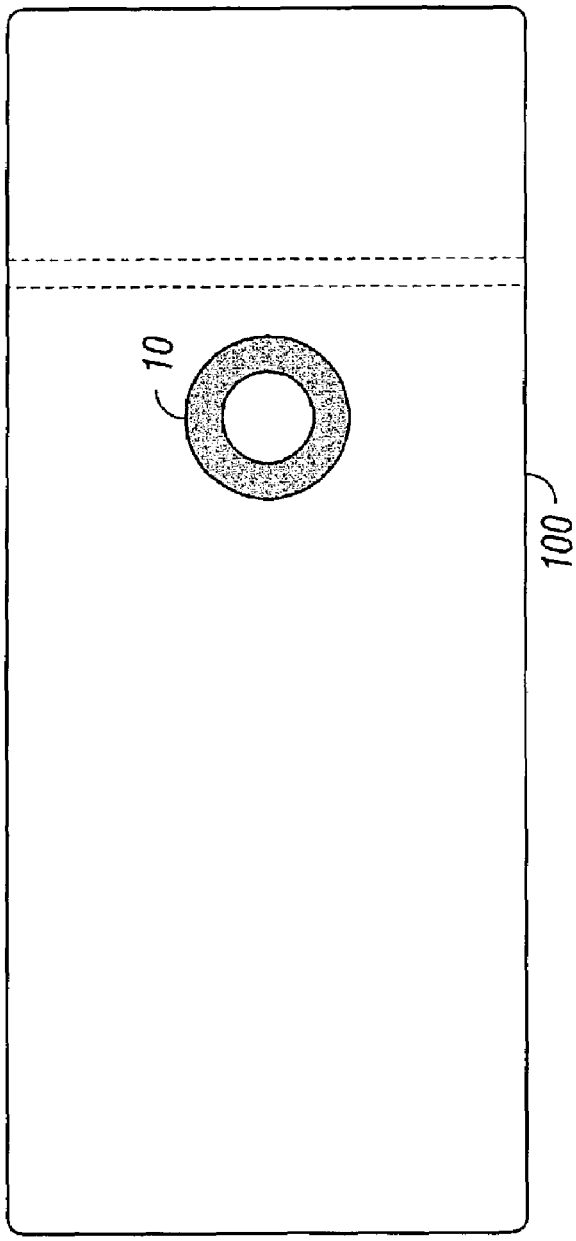
Figure 10B:
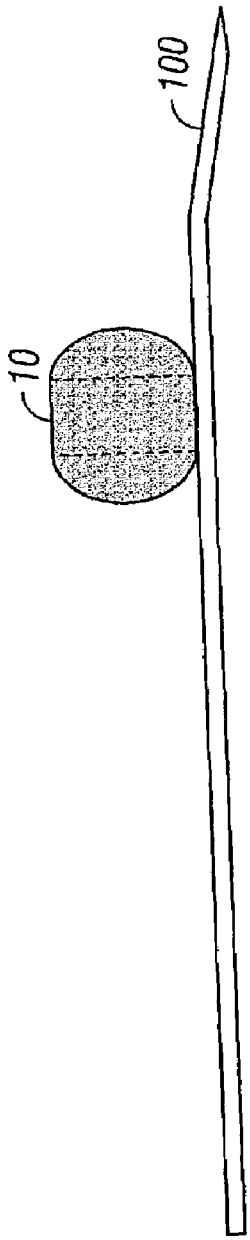

FIGS. 10A to 10C show an alternative hitting surface in accordance with the present invention.

DETAILED DESCRIPTION

The following description relates to non-limiting embodiments of the present invention.

Figure 1B:
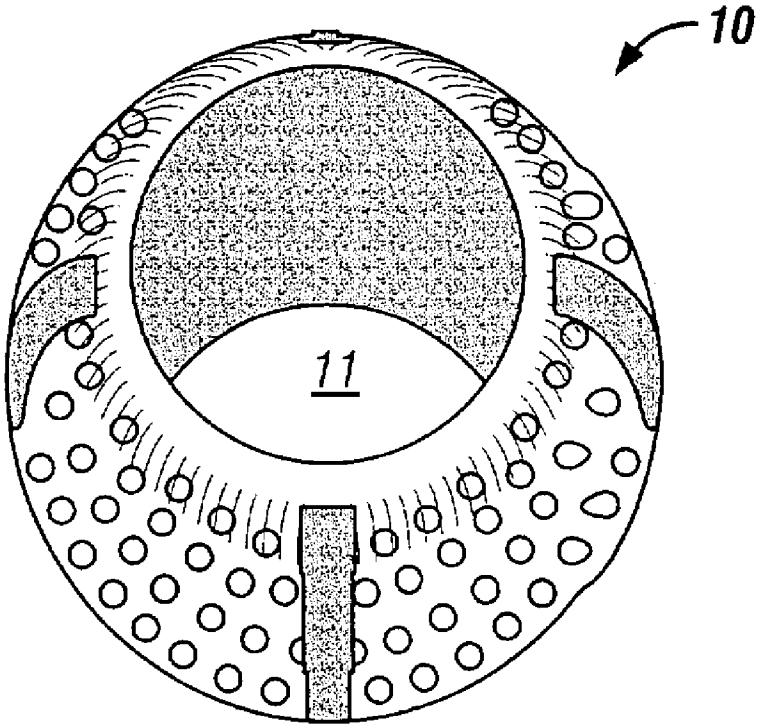
FIGS. 1A and 1B provide top perspective views of two non-standard spherically-shaped golf balls, in accordance with the present invention, wherein each of the two non-standard golf balls includes a relatively large diameter, center-located, circular-cylinder through hole in accordance with the invention, and wherein the two non-standard golf balls are provided with different external texturing.
Figure 1A:
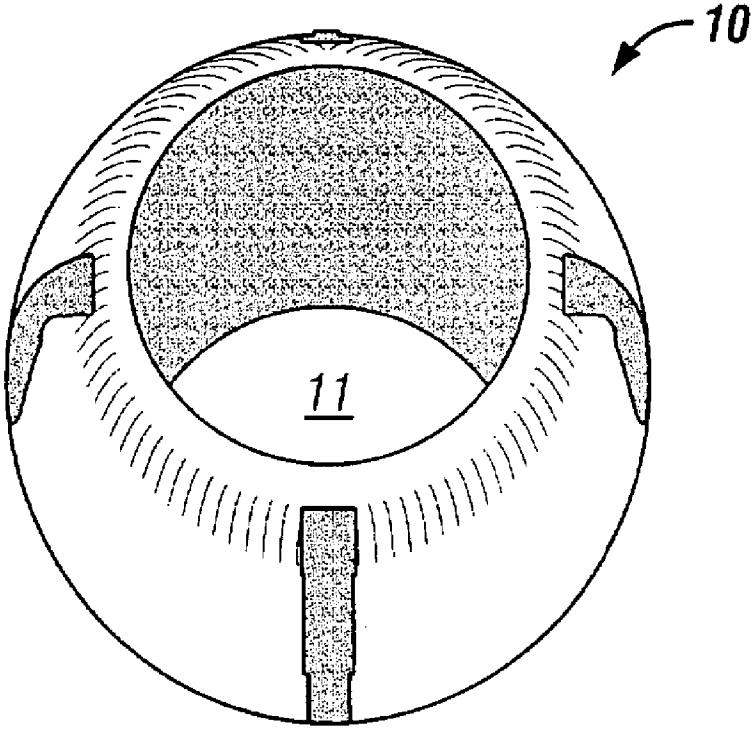

As shown in FIGS. 1A and 1B, the present invention provides a non-standard sport projectile, to be used like a golf ball, baseball, a football, etc., that is in the form of a three-dimensional, rigid polymer, ball-shaped or spherical-shaped body 10 having an annular void, through hole or opening 11 that extends entirely through the center body 10. In the embodiment of the invention that is shown in FIGS. 1A and 1B through hole 11 has a circular cross section and the linear central axis of the through hole 11 passes through the geometric center of body 10. As will be apparent, such a non-standard sport projectile 10 can have an external spherical shape or it may have a number of external tubular shapes. Generally, the non-standard sport projectile 10 works better with radiused sidewalls. While the majority of the description that follows, relates to non-standard or practice golf balls, one of ordinary skill in the art will recognize that alternative non-standard sport projectiles constructed and arranged in accordance with the invention are possible, for example non-standard baseballs, non-standard footballs, non-standard hockey pucks, non-standard soccer balls, non-standard tennis balls, etc. Any ball or sports projectile that when struck can have top spin or back spin in flight as a desired result. FIGS. 2A-2C shows other shapes of non-standard or practice sport projectiles, in accordance with the invention, that have different external shapes. FIG. 2A provides a side view of six different size non-standard golf balls 12, each of which has a flat top surface 13, a flat bottom surface 14 that is generally parallel to top surface 13, a circular-cylinder side surface 15 and a circular-cylinder through hole 16 that extends through non-standard golf ball 12 from its top surface 13 to its bottom surface 14. The linear central axis of non-standard golf ball 12 extends perpendicular to top surface 13 and bottom surface 14, the geometric center of non-standard golf ball 12 lies on this center axis, and the linear axis of through hole 16 is coincident with this center axis.

FIG. 2B provides a side view of five different size non-standard golf balls 15 having a somewhat flattened top surface 17, a somewhat flattened bottom surface 18 that is generally parallel to top surface 17, a slightly convex-curved side surface 19, and a circular-cylinder through hole 20. The linear central axis of non-standard golf ball 15 extends perpendicular to top surface 17 and bottom surface 18, the geometric center of non-standard golf ball 15 lies on this center axis, and the linear axis of through hole 20 is coincident with this center axis.

FIG. 2C provides a side view of four different size non-standard golf balls 21 having a somewhat flattened top surface 22, a somewhat flattened bottom surface 23 that is generally parallel to top surface 22, a spherically-curved side surface 24, and a circular-cylinder through hole 25. The linear central axis of non-standard golf ball 21 extends perpendicular to top surface 22 and bottom surface 23, the geometric center of non-standard golf ball 21 lies on this center axis, and the linear axis of through hole 25 is coincident with this center axis.

Side surfaces having other shapes will satisfy the spirit and scope of the invention, for example elliptical shapes, hour-glass shapes, etc. Further, while the above embodiments are shown having circular-cylinder through holes, other shapes for through holes are possible, such as square, rectangular, elliptical, triangular, etc.

Also, while three dimensional polymeric bodies such as shown in FIG. 1 and FIGS. 2A-2C closely match the look-and-feel of a standard golf ball, materials other than polymers can be substituted to make non-standard sports projectiles in accordance with the invention. For example, in the manufacture of non-standard sport projectiles spring steel can be used to make non-standard golf ball type projectiles, synthetic leather can be used to make non-standard football type projectiles, etc.

The body of a non-standard sport projectile, in accordance with the invention, is formed of a material that is strong enough to absorb the propelling force that is applied thereto when the non-standard sports projectile is stuck, such that the non-standard sports projectile does not break or shatter as a result of this striking force. Thus, for example, a stronger material may be needed when making a non-standard golf ball type projectile, in accordance with the invention, than would be needed when making a non-standard football type projectile, in accordance with the invention, due to the fact that the impact of a golf swing usually generates a greater propelling force than does a football kick.

Further, in order to obtain a proper rotation or tumble of the non-standard sport projectile after the projectile is hit, it is desirable, but it is not required, that the non-standard sports projectile, in accordance with the invention, be made of an elastic material that elastically deforms at the point of impact, which material thereafter substantially restores to its original shape after the non-standard sport projectile leaves the surface of a striking body, be it a golf club or the foot of a kicker.

As described above, non-standard sport projectiles, in accordance with the invention, include an annular (or ring shape) void or through hole that penetrates completely through the non-standard sport projectile. This annular void creates a surface-opening at two opposite surfaces of the non-standard sport projectile, for example an opening at both the "top" and an opening at the "bottom" of the non-standard sport projectile. While shown above as generally equal size opening in the top and bottom of the non-standard sport projectile, the openings can have different sizes.

Figure 8A:
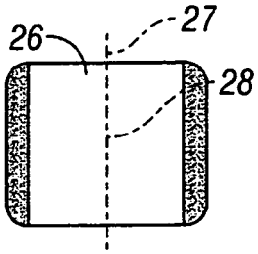
FIG. 8A is a cross section view of a non-standard golf ball as shown in FIG. 2A having a cylinder through hole.
Figure 8B:
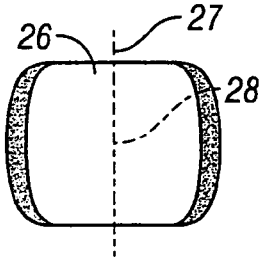
FIG. 8B is a cross section view of a non-standard golf ball as shown in FIG. 2B having a through hole whose diameter is greater at the center of the through hole than it is at the two ends of the through hole.
Figure 8C:
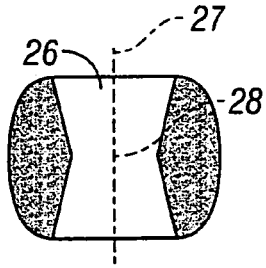
FIG. 8C is a cross section view of a non-standard golf ball as shown in FIG. 2C having a through hole whose diameter is smaller at the center of the through hole than it is at the two ends of the through hole.

As shown in FIGS. 8A-8C, this annular void or through hole 26 can be circular or non-circular in cross sectional shape, having straight walls that run the length of through hole 26 as is shown in FIG. 8A, having walls that taper inward to provide a narrow opening at the center or middle of through hole 26 as is shown in FIG. 8C, or having walls that taper outward to provide a wider area or flare at the center or middle of through hole 26 as is shown in FIG. 8B. In each case, the central axis 27 of through hole 26 extends through the geometric center 28 of the non-standard sport projectile. As one of skill in the art would recognize on reading the disclosure, the through hole is not necessarily aligned with the center axis, but it is believed the simulation to a standard projectile is closer with the through hole aligned with the center.

Figure 3B:
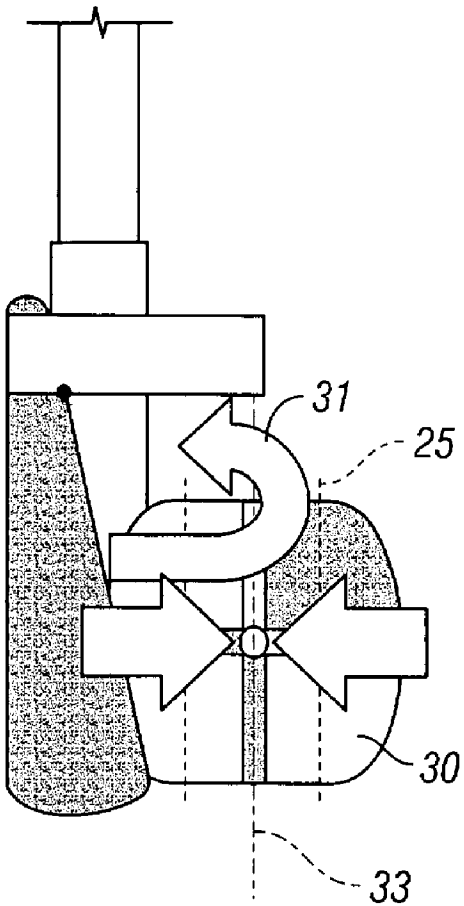
FIGS. 3A-3F show five sequential views that depict the striking of a non-standard golf ball of the type shown in FIG. 1 and the subsequent flight of the non-standard golf ball.
Figure 3A:
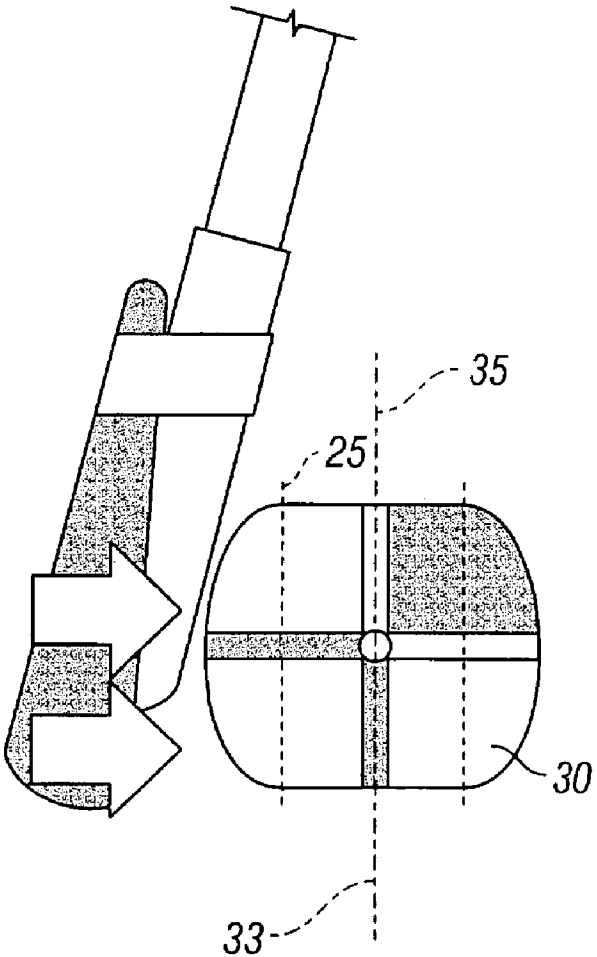
Figure 3C:
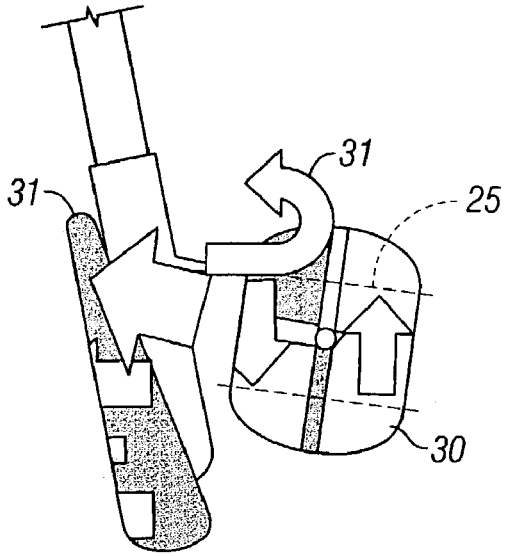
Figure 3D:
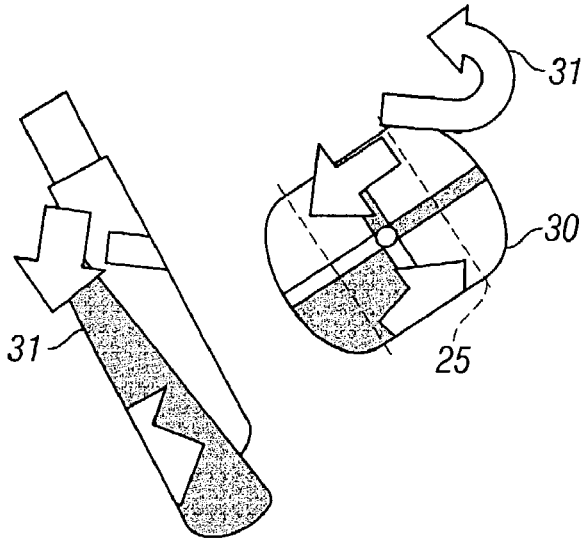
Figure 3E:
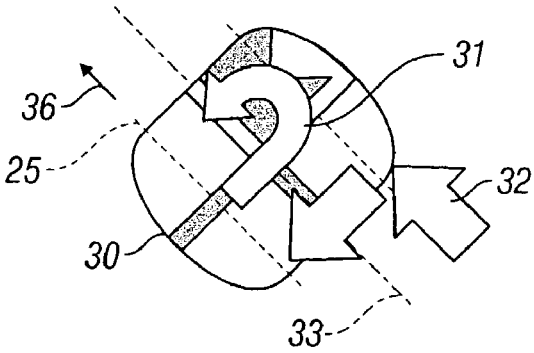
Figure 3F:
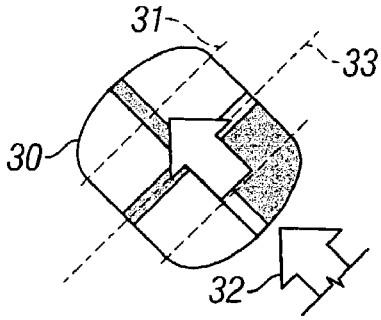

The most non-aerodynamic flight of a non-standard golf ball 30 that is constructed and arranged, in accordance with the invention, is shown in FIG. 3E wherein the direction of the non-standard golf-ball's spin is shown by arrow 31 and wherein the axis 33 of the non-standard golf ball's through hole is aligned with the direction of flight shown by arrow 32. In this attitude of non-standard golf-ball 30, air flows through the non-standard golf ball's through hole. The most aerodynamic flight of non-standard golf ball 30 is shown in FIG. 3F wherein the axis 33 of the non-standard golf ball's through hole extends in a direction that is generally perpendicular to the direction of flight 32. In this attitude of non-standard golf ball 30 little or no air flows through the non-standard golf ball's through hole.

As will be appreciated, due to the continuous spinning of non-standard golf ball 30, the two conditions that are shown in FIGS. 3E and 3F repeat as non-standard golf ball 30 flies through the air.

A narrowing of the non-standard sport projectile's through hole 28 as shown in FIG. 8C, or a flaring of through hole 26 as shown in FIG. 8B, either restricts or enhances airflow through through hole 26 as the non-standard sport projectile flies through the air after being hit, thereby controlling the non-aerodynamic flight of the non-standard sport projectile for the results desired.

Further, any of the through holes 26 shown in FIGS. 8A-8C can be partially blocked, for example by placing an air filter within a through hole 26, by placing an air-flow regulator within a through hole 26, by placing debris of some sort within a through hole 26, or by providing a whistle within a through hole 26, and the through hole 26 modified in this manner will continue to function properly.

Moreover, instead of providing only one through hole, a non-standard sport projectile, in accordance with the invention, can include several such through holes whose axes are arranged in parallel. In addition, these several through holes can have different cross sectional shapes, and/or these several through holes can have axes are that placed at an angle to each other, depending upon the flight characteristic that is desired of a particular non-standard sport projectile.

Figure 5A:
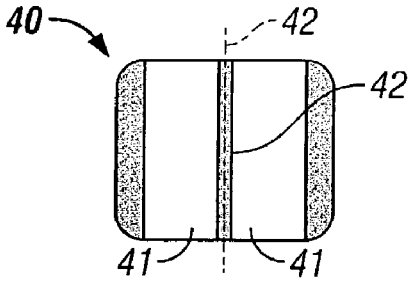
FIG. 5A is a side cross-section view of a non-standard golf ball of type shown in FIG. 2A wherein the non-standard golf ball includes eight center-located and parallel through holes, in accordance with the invention.
Figure 5B:
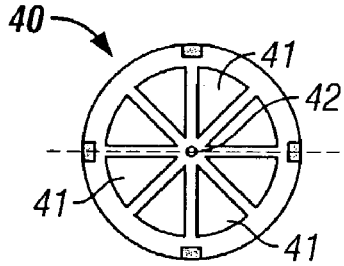
FIG. 5B is a top view of the non-standard golf ball of FIG. 5A.

FIG. 5A is a side cross section view of a non-standard golf ball 40 of type shown in FIG. 2A wherein non-standard golf ball 40 includes six center-located and parallel through holes 41, in accordance with the invention. FIG. 5B is a top view of non-standard golf ball 40, wherein it is shown that the six through holes 41 are symmetrically arranged around the central axis 42 of non-standard golf ball 40. As shown in these figures, central axis 42 of non-standard golf ball 40 passes through the geometric center 43 of non-standard golf ball 40.

Figure 6A:
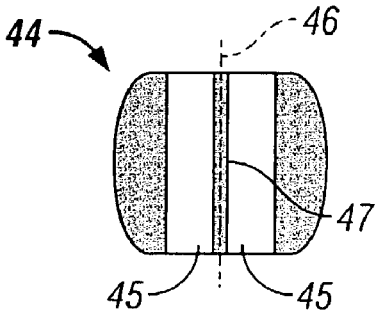
FIG. 6A is a side cross section view of a non-standard golf ball of type shown in FIG. 2B wherein the non-standard golf ball includes eight center-located and parallel through holes, in accordance with the invention.
Figure 6B:
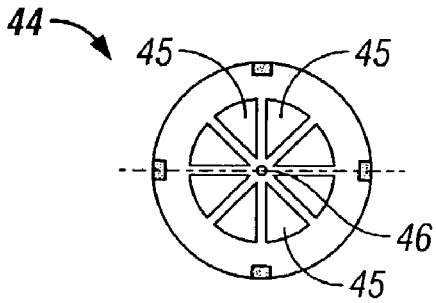
FIG. 6B is a top view of the non-standard golf ball of FIG. 6A.

FIG. 6A is a side cross section view of a non-standard golf ball 44 of type shown in FIG. 2B wherein non-standard golf ball 44 includes six center-located and parallel through holes 45, in accordance with the invention. FIG. 6B is a top view of non-standard golf ball 44, wherein it is shown that the six through holes 45 are symmetrically arranged around the central axis 46 non-standard golf ball 44. As shown in these figures, central axis 46 of non-standard golf ball 44 passes through the geometric center 47 of non-standard golf ball 44.

Figure 7A:
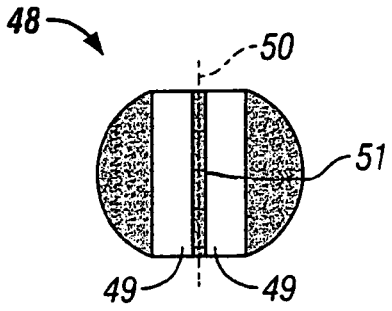
FIG. 7A is a side cross section view of a non-standard golf ball of type shown in FIG. 2C wherein the non-standard golf ball includes eight center-located and parallel through holes, in accordance with the invention.
Figure 7B:
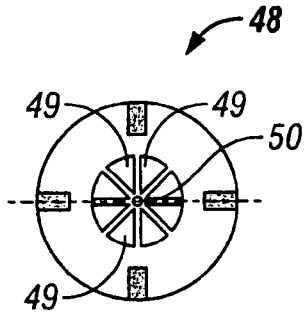
FIG. 7B is a top view of the non-standard golf ball of FIG. 7A.

FIG. 7A is a side cross section view of a non-standard golf ball 48 of type shown in FIG. 2C wherein non-standard golf ball 48 includes eight center-located and parallel through holes 49, in accordance with the invention. FIG. 7B is a top view of non-standard golf ball 48, wherein it is shown that the eight through holes 49 are symmetrically arranged around the central axis 50 of non-standard golf ball 48. As shown in these figures, central axis 50 of non-standard golf ball 48 passes through the geometric center 51 of non-standard golf ball 48.

The above-described through hole or through holes allow air to flow through the non-standard sport projectile after the sport projectile is hit, after it begins its flight, and as it spins. This spinning movement generally creates a lifting force as the sport projectile moves through the air. The amount of air that flows through the sport projectile's through hole or through holes, along with the non-standard sport projectile's speed of spin, influences the flight behavior of the non-standard sport projectile.

FIGS. 3A-3F are sequential view that show the striking and the subsequent flight of a non-standard golf ball 30 that is constructed and arranged consistent with the invention.

FIG. 3A shows a non-standard golf ball 30 of the present invention as the non-standard golf ball 30 (in this case a nonstandard golf ball as shown in FIG. 2B) sits with the axis 33 of its through hole 25 pointing vertically upward as the head of the golf club is about to strike non-standard golf ball 30. Where the club strikes the non-standard golf ball 30 may be referred to as a strike surface. In this position, non-standard golf ball 30 is in its least-aerodynamic position.

FIG. 3B shows the compression of non-standard golf ball 30 as the head of the club strikes non-standard golf ball 30 on the strike surface.

FIG. 3C shows non-standard golf ball 30 as it begins its flight and as non-standard golf ball 30 begins to spin in a counterclockwise direction as shown by arrow 31.

FIG. 3D shows the continued spinning 31 of non-standard golf ball 30.

FIG. 3E shows the least-aerodynamic position of the spinning non-standard golf ball 26 during its flight as shown by arrow 32, wherein the axis 33 of through hole 25 is generally aligned with flight direction 32.

FIG. 3F shows the most-aerodynamic position of the spinning non-standard golf ball 30 during its flight 32 wherein the axis 33 of through hole 25 extends generally perpendicular to flight direction 32.

As shown in FIGS. 3A-3F, when non-standard sport projectile 30 is struck, non-standard sport projectile rotates rapidly in a reverse or counterclockwise direction 31 around a central axis of rotation that includes the geometric center of non-standard sport projectile 30, this being demonstrated by spin arrow 31. Rotation 31 creates a periodic high airflow through the through hole 25 that is located generally at the center of non-standard sport projectile 30, as the projectile's through hole 25 moves into an out of alignment position with the projectile's direction of flight 32.

However, because through hole 25 is moving away from club head 31 at a high rate of speed, rotation 31 of non-standard sport projectile 30 also creates a braking effect, as the outer surface of non-standard sport projectile 30 and the sides of through hole 25 create a resistance-to-flight force, thereby reducing the distance that non-standard sport projectile 30 will travel as a result of club head 31 striking non-standard sport projectile 30.

More simply stated, as a spinning non-standard sport projectile constructed and arranged in accordance with the invention flies away from a point of impact with the club's head, movement of the non-standard sport projectile is slowed during the less-aerodynamic portion of the sport projectile's rotation shown in FIG. 3E. Because a non-standard sport projectile, in accordance with the invention, experiences generally equal parts airflow through its through hole (see FIG. 3E) and airflow restriction through its through hole (see FIG. 3F), the non-standard sport projectile generates a turbine-like whirring sound when it flies through the air, as airflow through through hole 25 repeatedly stops and starts at a relatively high rate of speed or frequency.

As mentioned above, the body of a non-standard sport projectile, in accordance with the invention, is sufficiently strong to prevent breakage of the non-standard sport projectile upon impact, and the body of the non-standard sport projectile has sufficient elasticity to provide hoop strength and rebound after striking. Thus, for a non-standard golf ball in accordance with the invention, the body is typically formed of a high strength polymer material, non-limiting examples of which are high density polyethylene, polyester elastomers, urethane, acetyls, and thermoplastic elastomers. Further, the inner core of non-standard sport projectiles, in accordance with the invention, can be formed of thin gauge tubular spring steel or high modulus polymer, with the non-standard sport projectile having a soft polymer outer coating.

FIG. 9A is a cross section view of a non-standard golf ball 55 of the type shown in FIG. 2A wherein non-standard golf ball 55 includes a circular-cylinder insert 56 that is made of spring steel or of a high flexural modulus polymer, the axis 57 of insert 56 being coincident with the axis of the non-standard golf ball's through hole 58.

FIG. 9B is a cross section view of a non-standard golf ball 59 of the type shown in FIG. 2B wherein non-standard golf ball 59 includes a circular-cylinder insert 60 that is made of spring steel or of a high flexural modulus polymer, the axis 61 of insert being coincident with the axis of the non-standard golf ball's through hole 62.

FIG. 9C is a cross section view of a non-standard golf ball 63 of the type shown in FIG. 2C wherein non-standard golf ball 63 includes a circular-cylinder insert 64 that is made of spring steel or of a high flexural modulus polymer, the axis of this insert being coincident with the axis 65 of the non-standard golf ball's through hole 66.

For a non-standard football, in accordance with the invention, the football's body is typically formed of a soft leather or leather-like material. For a non-standard baseball, in accordance with the invention, the baseball's body is typically formed of a material having characteristics that lie somewhere between the characteristic of a material that is used to make a non-standard golf ball and the characteristics of a material that is use to make a non-standard football.

The size of a non-standard sport projectile, in accordance with the invention, can be similar to the size of a corresponding standard sport projectile, but this size relationship is not required. That is, non-standard sport projectiles, of the invention, are usually of a size that is similar to a standard golf ball, a standard football, a standard soccer ball, a standard baseball, etc. However, larger or smaller non-standard sport projectile sizes can be provided, in accordance with the invention.

In particular, and when considering different types of golf club swings, larger size non-standard golf balls that satisfactorily mate with conventional golf club heads may be appropriate for use by beginning golfers, whereas smaller size non-standard golf balls that are more difficult to strike properly may be appropriate for use by expert golfers.

Figure 4A:
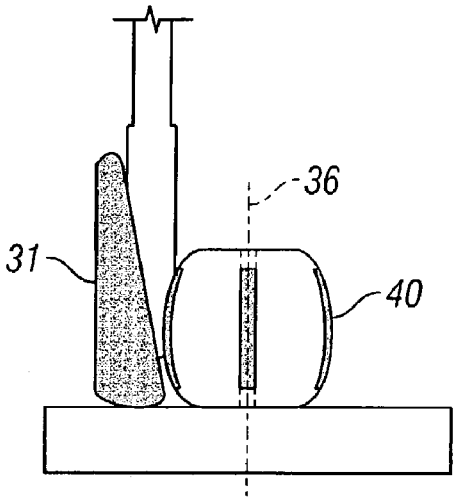
FIG. 4A shows a non-standard golf ball as shown in FIG. 2B as it sits on the ground with its through hole facing upward, and as the non-standard golf ball awaits the arrival of the head of a golf club.
Figure 4B:
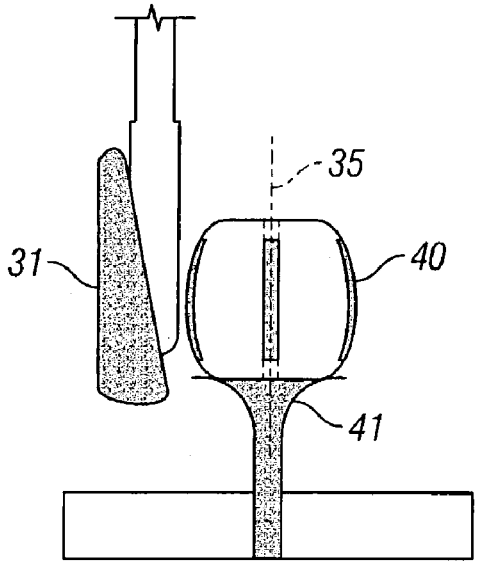
FIG. 4B shows a non-standard golf ball as shown in FIG. 2B as it sits on a tee with its through hole facing up, as the non-standard golf ball awaits the arrival of the head of a golf club.

During use, as is shown in FIG. 4A, a non-standard golf ball sport projectile 40, in accordance with the invention, may be placed on the ground, or as shown in FIG. 4B the non-standard golf ball 40 may be on a golf tee 41, so that the central axis 35 of the non-standard golf ball's annular through hole extends generally upward or vertical. This places the two through hole openings on the top and on the bottom of non-standard golf ball 40. In other words, its through hole sits upright. Note that in some instances an especially flared golf tee 41 may be desirable due to presence of the through hole that may make it inconvenient to use a conventional small-top tee 41 because of the tendency of the non-standard ball to fall to the ground. An alternative hitting surface will be explained below with respect to FIG. 10. With reference to FIG. 4B, which shows a non-standard golf ball 40 sitting on a tee, in the case of a football-type non-standard sport projectile, in accordance with the invention, the football's linear through hole is located generally coincident with the football's long axis. In an example, the football is placed on a kicking tee with its long axis and the axis of the through hole facing generally vertical. In the case of a baseball-type non-standard sport projectile, in accordance with the invention, the baseball's linear through hole extends through the geometric center of the baseball. In an example, and the baseball is placed on a hitting tee with the axis of its through hole facing generally vertical. In the case of a soccer ball-type non-standard sport projectile, in accordance with the invention, the soccer ball's linear through hole extends through the geometric center of the soccer ball. In an example, and the soccer ball is placed on the ground with the axis of its through hole facing generally vertical.

As shown in FIGS. 3A-D, a golf club head having a positive loft produces a reverse or counterclockwise spin of non-standard golf ball 40 when the head of the golf club strikes non-standard golf ball 40, and when non-standard golf ball 40 subsequently leaves club head 31. This spin is created by the positive loft of the head, by friction that exists at impact with non-standard golf ball 40, and by deformation of non-standard golf ball 40 as is shown in FIG. 3B. Further, upon initial impact by head 31, non-standard golf ball 40 is in its least aerodynamic orientation. The vertical position of the axis 35 of the though-hole at club head impact provides the "feel" of a standard golf ball due to the non-aerodynamic resistance that is provided by nonstandard golf ball 40, which in turn adds a component of force to the club's head 31.

When a non-standard sport projectile, in accordance with the invention, is in this through hole axis upright position, the leading surface of the sport projectile, whether it be an aerodynamic surface or a flattened surface, facilitates a spin of the non-standard sport projectile, and the rate of spin of the non-standard sport projectile is reduced as the non-standard sport projectile becomes less aerodynamic as its through hole begins to take-in air.

As rotation of the non-standard sport projectile continues, air no longer flows through the through hole, and air now hits the outside surface of the non-standard sport projectile, thus creating a braking or slowing force to the non-standard projectile's flight or horizontal motion.

Airflow into the non-standard projectile's through hole first acts as a brake, and when air no longer flow through the though-hole air flowing over the non-standard sport projectile acts as an aerodynamic lift or boost. Thus airflow through the through hole creates a slowing/braking force for the non-standard sport projectile. Therefore, the non-standard sport projectile is alternately aerodynamic and then non-aerodynamic during its rotation and its flight. Thus causing a whirring sound, somewhat like a turbine reversing, when the non-standard sport projectile is struck by an object such as golf club and then flies through the air.

As a result, flight of the non-standard sport projectile is shortened, but the nonstandard sport projectile mimics the feel and flight path of a standard sport projectile. That is, using a non-standard sport projectile, in accordance with the invention, such a non-standard golf ball, is satisfying to the golfer. The flight that is provided by non-standard sport projectiles, in accordance with the invention, are perfect for practicing the art of golf ball hitting, or the art of striking any standard sport projectile whose use requires a large geographic area, such as, for example, kicking a football to practice field goals, or hitting a baseball. A non-standard sport projectile, in accordance with the invention, can be struck without requiring the use of a net or the like within neighborhoods and parks. Further, similar to a standard golf ball, a non-standard golf ball, in accordance with the invention, will slice when the club's head is open at impact, and it will draw when the club's head is closed at impact. However, because a non-standard sport projectile, in accordance with the invention, provides a reduce flight distance, retrieval time is reduced and retrieval is less tedious. On reading this disclosure, one of ordinary skill in the art will recognize that the non-standard golf ball can be designed to increase or decrease the ability to fade or draw. In particular, if one or more ribs or ridges, similar to a gear shape cross-section, are place in the through hole or on the external surface, the non-standard golf ball can be designed to fade or draw. Further, altering the shape of the non-standard ball such that the shape is more oval instead of cylindrical may also alter the fade or draw of the non-standard ball.

Referring specifically to non-standard sport projectiles of the golf ball type, for simplicity, the weight of a non-standard golf ball, in accordance with the invention, is usually only a fraction of the weight of a standard golf ball. The weight of a nonstandard golf ball in accordance with the invention is a function of the physical size of the non-standard golf ball and is a function of the type of material that is used in its construction. In general, the heavier the non-standard sport projectile, the greater the inertia of the non-standard sport projectile that must be overcome on impact. However, the configuration of the non-standard sport projectile's through hole, and the proportion of the through hole relative to the overall height and diameter of the non-standard sport projectile, is also important when enhancing or restricting flight of the non-standard sport projectile. Because a non-standard golf ball, in accordance with the invention, is intended for use in practicing various golf swings, such a nonstandard golf ball is effective through a wide range of projectile weights.

A USGA conforming standard golf ball weighs 1.6 ounces. A non-standard golf ball of the present invention can also have a weight of 1.6 ounces. However, the weight of a non-standard golf ball of the invention is usually less due to the presence of the above-described through hole. Thus, a non-standard golf ball, in accordance with the invention, is usually significantly lighter than a standard golf ball.

Because the golf club's "feel" at impact is important when learning to hit a golf ball properly, a weight of at least 0.3 ounces adequately simulates the feel of a standard golf ball, however lower weights are possible within the spirit and scope of the invention. Moreover, generally, the flight distance of a standard sport projectile is dependent not only on the striking force, but it is also dependent upon a spring-back of the materials or materials that make up the standard sport projectile, as well as the weight of the standard sport projectile, with lower weight standard sport projectiles generally traveling a shorter distance. Non-standard sport projectiles, in accordance with the invention, are non-aerodynamic for about one-half of the non-standard sport projectile's travel or flight time, and as a result the non-standard sport projectile travels a fraction of the distance that a standard sport projectile, such as a golf ball, travels. However, because a rotating non-standard sport projectile, in accordance with the invention, acts as an air foil for about one-half of its flight time, the non-standard sport projectile has an aerodynamic lift, and it replicates the trajectory of a standard sport projectile such as a golf ball, although the non-standard sport projectile's trajectory is significantly shortened by the braking action that occurs during the non-aerodynamic portion of the non-standard projectile's rotation. Therefore, non-standard sport projectiles, in accordance with the invention, can be struck in backyards, neighborhoods and parks without requiring a net. Once again referring to a non-standard golf ball, in accordance with the invention, it has been found that a proportion or ratio of the solid outer surface of the non-standard golf ball to the open through hole surface can be as high as about 12 to 1 or a low as about 4 to 1. However this is a non-limiting function of design choice.

A surface ratio that is more than 4 to 1 does not function as well because such a larger ratio creates a smaller size through hole that provides less airflow. The ratio of the area of the through hole to the height or length of the through hole can vary. However it has been found that when a non-standard golf ball of the invention is in its upright or striking position, with the central axis of the through hole extending generally vertical, a through hole area that is about the equal to the height of the through hole works satisfactorily. However, this through hole diameter to through hole height ratio can be much lower, for example to up to 12 times or more. As will be appreciated, the flight and distance of a non-standard golf ball, in accordance with the invention, is a function of the loft that is provided by the golf club head and the speed at which the golf club head strikes the non-standard golf ball.

The polymeric material from which the non-standard golf ball is made, if it is high in flexural modulus, will rebound off of the golf club's face much like a standard golf ball. This polymeric material should have sufficient strength to provide hoop strength and spring back. This spring back effect is important because the resulting rebound action is required as the non-standard sport golf ball leaves the club's head.

As mentioned above, a novel and unobvious hitting surface can be constructed for the non-standard golf ball type projectile. FIGS. 10A, 10B and 10C show an alternative hitting surface 100. Hitting surface 100 can be made of many types of material, like plastic, natural grass, Astroturf, or the like, but it has been found that plastics (similar to the polymers used to make the golf type projectile) work well. Generally, as shown in FIG. 10B, hitting surface 100 has an incline. Placing non-standard golf ball 102 on hitting surface 100 progressively up the hitting surface simulates a higher and higher "teeing" of the non-standard golf ball. Because the non-standard golf ball has somewhat flattened top and bottom surfaces (as explained above), the non-standard ball 102 will not role down the inclined hitting surface. This hitting surface has been found useful because it is difficult to obtain golf tees having especially flared tee surfaces to support the non-standard golf ball. Also, using the hitting surface allows use of the non-standard golf balls in the backyard without causing undue divots in the yard.

Depending upon of the non-standard sport projectile's ratio of through hole diameter to through hole length, as well as on how well the non-standard sport projectile is struck, the non-standard sport projection may spin until it lands, or until it stalls and then floats to the ground.

What is claimed is:

1. A non-standard practice sport projectile for use within a relatively small geographic area, the non-standard projectile for practicing a striking motion associated with a sport, the non-standard sport projectile comprising:

a generally rigid body comprising a material with a high flexural modulus, the generally rigid body having an external surface and a geometric center;

at least one linear through hole extending completely through the generally rigid body about its geometric center, to create at least one first-surface-opening on the external surface of the generally rigid body, and to create at least one second-surface-opening on the external surface of the generally rigid body at a location that is opposite the at least one first-surface-opening, a remaining portion of the generally rigid body being devoid of through holes; and the generally rigid body having at least one strike surface on the external surface, such that striking the strike surface causes the generally rigid body to move in a direction, and with a rotation of the generally rigid body about an axis defined by the at least one through hole that provides a relatively high aerodynamic phase, and provides a relatively low aerodynamic phase as the at least one linear through hole rotates between being parallel and perpendicular to a direction of flight and causes the generally rigid body to move over a trajectory that substantially mimics a trajectory of a standard sports projectile but over a distance substantially reduced from a distance the standard sports projectile travels.

2. The non-standard practice sport projectile of claim 1 selected from a group consisting of a golf ball.

3. The non-standard practice sport projectile of claim 1 wherein the external surface is selected from a group consisting of a cylindrical surface, a convex surface, a spherical surface, or an elliptical surface.

4. The non-standard practice sport projectile of claim 1 wherein the at least one linear through hole is selected from a group consisting of a single though-hole that extends through the geometric center, or a plurality of through holes that are generally parallel and symmetrically surround the geometric center.

5. The non-standard sport projectile of claim 4 wherein the external surface includes a solid external surface that is devoid of through holes, the at least one first-surface-opening, and the at least one second-surface-opening, and wherein a ratio of an area of the solid external surface to an area of the surface openings is in the range of from about 1-to-1 to about 12-to-1.

6. The non-standard practice sport projectile of claim 5 selected from a group consisting of a golf ball.

7. The non-standard practice sport projectile of claim 5 wherein the solid external surface is selected from a group consisting of a cylindrical surface, a convex surface, a spherical surface, or an elliptical surface.

8. The non-standard practice sport projectile of claim 7 selected from a group consisting of a golf ball.

9. The non-standard practice sport projectile of claim 1 wherein the at least one linear through hole includes internal side walls selected from a group consisting of straight side walls, converging side walls, or diverging side walls.

10. The non-standard sport projectile of claim 9 wherein the external surface of the generally rigid body includes the remaining portion of the generally rigid body, the at least one first-surface-opening, and at the least one second-surface-opening, and wherein a ratio of an area of the remaining portion of the generally rigid body to a total of an area of the at least one first-surface-opening and at least one second surface opening is in the range of from about 1-to-1 to about 12-to-1.

11. The non-standard practice sport projectile of claim 10 wherein the at least one linear through hole is selected from a group consisting of a single through-hole extending through the geometric center or a plurality of through holes that are generally parallel and surround the geometric center.

12. The non-standard practice sport projectile of claim 11 selected from a group consisting of a golf ball.

13. The non-standard practice sport projectile of claim 1, wherein:

a height of the generally rigid body is less than a width of the generally rigid body.

14. The non-standard practice sport projectile of claim 1, wherein the material with a high flexural modulus is selected from the group of materials consisting of: a metal or a polymer.

15. The non-standard practice sport projectile of claim 14 selected from a group consisting of a golf ball.

16. A method of practicing a physical movement that is associated with a sport wherein a projectile is hit by an object, comprising the steps of:

providing a generally rigid body comprising a material with a high flexural modulus, the generally rigid body having an external surface and a geometric center;

providing at least one linear through hole extending completely through the generally rigid body and its geometric center, to thereby create at least one first-surface-opening on the external surface of the generally rigid body, and to thereby create at least one second-surface-opening on the external surface of the generally rigid body at a location that is opposite the at least one first-surface-opening, a remaining portion of the generally rigid body being devoid of through holes;

arranging the generally rigid body to be hit by an object by placing the at least one first-surface-opening on a surface, hitting the generally rigid body with the object; and causing movement or the generally rigid body in a direction, and rotation of the generally rigid body about its geometric center, such that the generally rigid body alternates between a relatively high aerodynamic phase and a relatively low aerodynamic phase as the generally rigid body rotates about its geometric center and causes the generally rigid body to move over a trajectory that substantially mimics a trajectory of a standard sports projectile but over a distance substantially reduced from a distance the standard sports projectile travels.

17. The method of claim 16 including the step of:

providing a single through hole having a linear axis that extends through said geometric center.

18. The method of claim 17 including the step of:

selecting the single through hole from a group consisting of a straight-wall through hole, a diverging-wall through hole, or a converging-wall through hole.

19. The method of claim 18 including the step of:

selecting the external surface from a group consisting of a cylindrical surface area, a convex surface area, a spherical surface area, or an elliptical surface area.

20. The method of claim 16 including the step of:

selecting the non-standard sport projectile from a group consisting of a golf ball.

21. The method of claim 16, wherein the causing step includes the step of:

constructing the at least one liner through hole in a manner to apply an aerodynamic braking force to the movement of the generally rigid body.

22. A non-standard practice sport projectile for use within a relatively small geographic area, the non-standard projectile for practicing a striking motion associated with a sport, the non-standard sport projectile comprising:

a generally rigid body comprising a material with a high flexural modulus, the generally rigid body having an external surface and a geometric center;

the generally rigid body having at least one strike surface on the external surface whereby striking the strike surface causes a rotation of the generally rigid body as the generally rigid body moves in a direction; and at least one generally linear through hole means extending generally through the geometric center of the generally rigid body and operable to aerodynamically brake the generally rigid body during a portion of the rotation of the generally rigid body, such that a trajectory of the generally rigid body mimics a trajectory of a standard sports projectile but over a distance that is substantially reduced from a distance the standard sports projectile travels.

23. The non-standard practice sport projectile of claim 22 selected from a group consisting of a golf ball.

24. The non-standard practice sport projectile of claim 22 wherein the external surface is selected from a group consisting of a cylindrical surface, a convex surface, a spherical surface, or an elliptical surface.

25. The non-standard practice sport projectile of claim 22 wherein the generally linear through hole means is selected from a group consisting of a single linear through hole that extends through the geometric center, or a plurality of linear and generally parallel through holes that symmetrically surround the geometric center.

* * * * *